United States Patent [19]

Jeter

[11] 4,027,282

[45] May 31, 1977

[54] METHODS AND APPARATUS FOR TRANSMITTING INFORMATION THROUGH A PIPE STRING

[75] Inventor: John Doise Jeter, Iowa Park, Tex.

[73] Assignee: Texas Dynamatics, Inc., Dallas, Tex.

[22] Filed: Oct. 18, 1974

[21] Appl. No.: 515,962

[52] U.S. Cl. ..... 340/18 NC; 340/18 P

[51] Int. Cl.[2] ..... G01V 1/40

[58] Field of Search ..... 340/18 LD, 18 NC, 18 P

[56] References Cited

UNITED STATES PATENTS

| | | | |
|---|---|---|---|
| 3,732,728 | 5/1973 | Fitzpatrick | 340/18 NC |
| 3,906,434 | 9/1975 | Lamel et al. | 340/18 LD |

*Primary Examiner*—Howard A. Birmiel

[57] ABSTRACT

A device attached to a pipe string extending from the earth surface to subsurface locations, primarily for earth boring activities to transmit information from the subsurface location to the earth surface. The readings of subsurface sensors are converted to a message comprising a combination of pressure pulses in fluid in the pipe string and brief stress changes in the wall material of the pipe string detectable in the pipe string at the earth surface, the combination identifiable as representing at least part of the message and series of pulses collectively representing the content of the message being transmitted.

19 Claims, 13 Drawing Figures

METHODS AND APPARATUS FOR TRANSMITTING INFORMATION THROUGH A PIPE STRING

In operations related to mineral recovery such as drilling in earth bore holes, it is often desirable and often necessary to transmit to the earth surface quantitative and qualitative information determinable by sensors in a subsurface location. It has long been desirable to transmit sensed information from subsurface apparatus attached to pipe strings extending to the earth surface by pressure pulses created in a fluid stream being pumped down the bore of the pipe. Transmission of information by pressure pulses is not widely used because of problems with attenuation of the pressure pulse in deep operations and background noise created by reciprocating pumps customarily used to pump fluid down the pipe string. Costly alternate methods of information transmission are still common.

Pressure pulses created in deep subsurface locations have limited information value because they are distorted in shape by attenuation and apparently displaced in time of arrival at the surface by contamination with background noise. The spacing between pulses created within a limited timespan, then, has limited resolution as information. Pulse duration is similarly limited for the same reason. The pressure differential between pulse peak and background is so distorted by attenuation and noise that few attempts have been made to utilize pressure differential as an information transmission medium. A binary code transmission can be carried out by transmitting a series of symbols typified by a numerical expression as a message and by assigning a time interval for message transmission which consists of a series of time increments, each increment assigned a place in the numerical expression, the particular symbol related to a particular increment being identified as one of the two depending upon whether a pressure change, or the absence of a pressure change, is transmitted during the increment. Qualitative information can, of course, be transmitted by the numerical expression by assigning any information one of the two symbols such as valve open equals 0, valve closed equals 1.

Definitions are in order, and hereinafter, a zero pressure pulse defined by the absence of a change in pressure in the fluid stream at an assigned time will be referred to as a passive pulse; a pulse distinguishable as a temporary pressure change in the fluid pressure will be referred to as an active pulse. Further, when necessary to distinguish between active pulses having a temporary increase in pressure and active pulses having a temporary decrease in pressure, they will be referred to as positive pulses and negative pulses respectively. Brief changes in axial drill pipe stress and brief changes in pipe string rotational torque created for signal purposes will be called pulses. Additionally, high frequency cyclic variations imposed upon pulses during pulse generation will be referred to as cyclic pulses even if only the high frequency component is detectable at the earth surface in either or both the fluid or pipe string. Cyclic variations can occur at many frequencies each of which will be called channels.

As the range of transmission is reduced and more pulse characteristics can be distinguished, the base of the numerical system used can be enlarged. This makes possible greater resolving power in a message limited to a specific number of pulses. To eliminate the need for exact time increment division, the passive pulses can be eliminated and positive and negative active pulses can be used to represent the two binary symbols. Further, if necessary and timing is not difficult, a trinary numerical message may be composed of positive pulses, negative pulses and passive pulses. If circumstances permit the transmission of active pulses having characteristics to distinguish each pulse from all other dissimilar pulses, a numerical system may be used in information transmission that has a base corresponding to the number of separately distinguishable pulses transmittable. For instance, if two forms of positive pulses and two forms of negative pulses can be transmitted, a numerical system of base four may be utilized. Pulses may be used in series, each pulse in the series corresponding to an assigned place in the numerical expression transmitted. Each pulse distinguishable characteristic will serve to identify it as representative of the particular symbol occupying the place in the numerical expression that the particular pulse, by its place in the series of pulses, represents.

In a fluid filled pipe string, both the fluid and the pipe string can serve as a pulse transmission media. The pipe string can also transmit pulses in two modes, as axial stress changes, and as rotational torque changes. There are, then, three modes of pulse communication in two media. Many different frequencies of cyclic variations, or channels, in any mode of pulse communication can be superimposed over the conventional slow change pulse.

In any selected drilling situation, the transmittability of information along a drill string in any mode or method can change in seconds to render a signal useless. Compressability of fluid changes rapidly and alters the range of high frequency fluid cyclic pulses. Pump valve performance change and the change in synchronization of multiple plunger pumps often confuse low frequency pulses in the fluid stream. Slippage of drill string stabilizers over strata induced ledges and uneven down feed of the drill string surface gear causes surges in both torque and indicated bit load to confuse low frequency pulses in the drill string. Shock input to the drill string by a drilling roller bit transmits on all frequencies with such energy that those frequencies best transmitted will compete with the best of signal gear transmitting high frequency in the drill stage. Fortunately, the random occurrence of the aforementioned problem noise does not strike all modes, media and frequencies of signal transmission simultaneously.

It is possible to transmit pulses in all the aforementioned modes, media and many frequencies simultaneously, but since signals travel at different velocities in the different media, problems on the receiving end can be anticipated. The problem of multiple signals arriving at the earth surface with their relative times of occurrence distorted when compared with their rleative times of generation down hole can be solved by recording the signals as they arrive and introducing a delay before display of each signal that is proportional to the signal velocity in the media by which it was communicated.

It is expedient to use the abundent energy of the fluid stream to generate the energy used to communicate by all modes. The most economical and longest range signal system using the various modes and frequencies is one that puts such energy into each of the signals relied upon that the signals detectable will all be equally detectable at their transmission range limit. No power is then wasted and no vital signal is lost. Means to selectively distribute energy among the signal media is essential to maximization of transmission range.

The use of filters to separate one range of frequencies from another so that the content of each channel can be separately evaluated is well established and can serve the purpose of symbol identification relative to pulses. Such separation can also serve to control the amplification of signals communicated by one mode by signals transmitted by other modes so that for noise to cause a false signal, all media, modes and channels so controlled will have to be noise laden simultaneously.

It is therefore an object of this invention to provide apparatus to transmit information from subsurface equipment to the earth surface that requires no extrapolation or interpolation.

It is another object of this invention to transmit information by a sequence of pulses which require only evidence of their existence or absence of one of a combination of signal components at a particular time for each pulse to convey the information content assigned to the particular pulse.

It is another object of this invention to provide apparatus to transmit information from subsurface equipment attached to a pipe string to the earth surface by utilizing fluid pressure and wall stress pulses in the pipe string without relying on space between pulses or pulse pressure differential for quantitative information.

It is another object of this invention to provide apparatus to convert readings from subsurface sensors into a series of pressure pulses to be transmitted through a pipe string, representing a numerical expression of high resolution unchanged by attenuation in travel and unchanged by distortion by background noise at the receiving end.

It is another object of this invention to provide method and apparatus to transmit information from subsurface device to the earth surface by fluid pressure and pipe wall stress pulses that represent symbols in a numerical system having a base corrsponding to the number of different distinguishable pulses used in transmission.

It is another object of this invention to use separator pulses to denote a separation between information pulses, the characteristics of signals during the information pulse serving to identify the interval as representative of a particular symbol in a series of different symbols used in information transmission.

It is another object of this invention to provide apparatus to superimpose higher frequency cyclic variations on fluid pressure change pulses to extend their detection range.

It is another object of this invention to provide apparatus to communicate pulses in the various modes of conduction in combinations that identify pulses as representative of particular symbols.

It is another object of this invention to convert energy of the moving fluid stream into signal energy to be expended in the fluid stream and in the drill string wall material and to regulate the distribution of energy among the modes used to communicate.

It is another object of this invention to provide apparatus to compensate for the difference in signal velocities in the different communication media so that signals may be displayed in the time relationship with which they were generated.

It is another object of this invention to provide apparatus to utilize the turns of a pipe string relative to earth to identify symbols represented by delay between pulses by synchronizing down hole and surface delay measuring means.

It is another object of this invention to use signals produced by different modes as an amplification factor for other signals so that the absence of both signal and noise, at the receiving end, in any mode so used will negate indications of pulses due solely to noise.

It is another object of this invention to provide apparatus to utilize the flow of fluid through the bore of a pipe string to equalize pulse spacing measurements at the surface and at the down hole location.

It is another object of this invention to utilize pipe string rotation rate and fluid flow rate as control media for down hole transmitters so that the transmitters can be used when desired and as desired by decisions transmitted from the earth surface.

These and other objects, advantages and features of this invention will be apparent to those skilled in the art from a consideration of this specification, including the attached drawings, and appended claims.

BRIEF DESCRIPTION OF DRAWINGS

In the drawings, wherein like reference characters are used throughout to designate like parts.

DETAILED DESCRIPTION OF DRAWINGS

Figure 1:
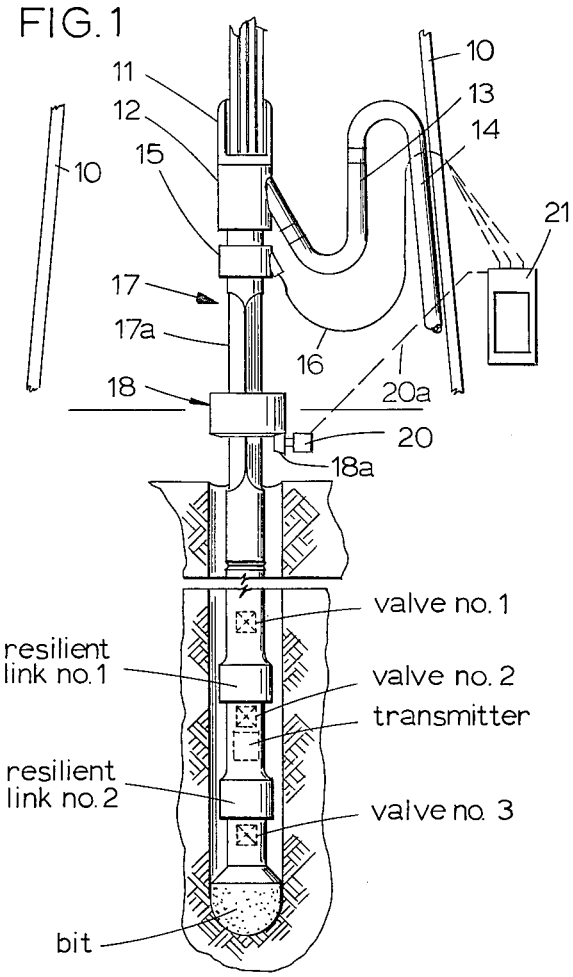
FIG. 1 represents a generalized outlay of a conventional drilling rig with drill string shown and the device of this invention in place.

In accordance with the method and apparatus of this invention as a typical use situation, FIG. 1 represents a conventional drilling rig with a pipe string assembly down hole and instrumentation at the earth surface. Only the lower end of the usual derrick 10 is shown. Drill string 17 hangs from traveling block 11 by swivel 12. Fluid to be pumped down the drill string moves through standpipe 14, through flexible hose 13 and into swivel 12. Slip ring assembly 15 contains strain measuring means for detecting axial stresses in the drill pipe. Fluid pressure pulse detector placement is optional, but in this case it is in assembly 15. Leads 16 carry signals from transducers to display package 21.

A Kelly 17*a* extends through a rotary table and drive bushing assembly shown as 18. The rotary drive 18*a* is fitted with sensor 20 to measure torque and, of course, torque changes.

A transmitter is shown near the lower end of the drill string. The transmitter is described in detail relative to FIGS. 8 and 9. The transmitter of FIG. 8 derives power from the fluid stream to produce pressure changes as signals in the fluid stream. As will be described, the transmitter can convert energy derived from the fluid stream directly to a hammer like signal to be transmitted axially along the drill string to the surface. Conversion of fluid pressure energy to other modes of communication involves the use and relative positioning of drill string resilient elements as will later be described in detail.

A fluid pressure signal transmitted as a fluid pressure pulse in the fluid in the drill string will have an influence upon axial pipe string wall stress. Axial wall stress as representing drill string axial stretch will have an influence upon torque that is dependent upon placement of resilient drill string elements relative to pressure pulse generating means if a drill bit is drilling. At the lower end of drill string 17, two resilient links are shown and may be regarded as shock subs or bumper subs. Three valves in the fluid stream for signal generation are shown. The number used is optional. All the valves or any valve may be operated by the device of FIG. 8. The restricting of flow through valve no. 1 will cause a pressure pulse in the fluid and an axial stress pulse in the drill string wall, but little torque change because there are two axially resilient links below. Restriction by valve no. 2 will deliver both low and high frequency pulses into the fluid in the pipe but only low frequency into axial stress in the drill string because high frequency will not transmit through the resilient link above the valve. More torque will be generated, in this case, if a bit is drilling because only one resilient link is below the valve. If a drill bit is on bottom and drilling, restriction of flow by valve no. 3 will cause a torque pulse and a fluid pressure pulse. Little high frequency axial stress will travel through the two resilient links and downthrust by the fluid column on valve no. 3 will act directly upon the bit to influence torque. It is seen, then, that the ratio of energy put into fluid pressure, axial stress and torque pulses can thus be regulated by pipe string resilience and flow restriction means placement, particularly placement of flow restriction devices relative to points of substantial resilience.

Figure 2:
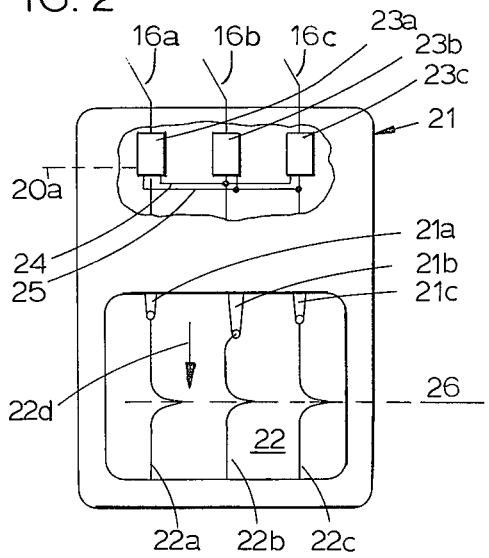
FIG. 2 is a view in elevation of a recorder and display unit enlarged from a part of FIG. 1.

Instrument package 21 of FIG. 1 is enlarged in FIG. 2. A strip chart recorder is shown. Three pens are shown, but any number may be used.

It may be assumed that a transducer sensing fluid pressure in assembly 15 is connected through multiple conductor lead 16 to entry lead 16*a*, to be amplified 23*a* to drive a pen motor attached to pen 21*a* to make trace 22*a* on chart 22 moving in the direction of arrow 22*d*. Further, torque sensor 20 conveys a signal through lead 20*a* that must be present for an electrical pulse in lead 16*a* to cause pen 21*a* to show a graphic pulse. The same applies in reverse. A pulse in lead 20*a* will not influence pen 21*a* unless a pulse exists in lead 16*a*. Assume also that signal conditioning in amplifier 23*a* produces a simple change pulse from a cyclic pulse if such is present. Normal amplification and mixing controls permit an operator to set up the parameter relationships within amplifier 23*a* that squelch noise and minimize signal loss and optionally balance signal influence. This is commonly available hardware and, hence, is not detailed.

Signals generated in the drill string wall and in fluid will travel at different speeds to the surface and this requires compensation. Means for synchronizing the display of detected signals so that they can be presented and viewed or evaluated with the time relationships in which they were created down hole involves placement of penmotor writing points relative to other writing points and the direction of chart movement. Such placement will assure that signals received at various times will, due to chart movement, arrive at a particular display point or reference line with the time relationships with which they were generated down hole.

The down hole transmitter can transmit in two media, three modes and any number of channels and the surface instrumentation is defined accordingly. The number of writing pens used may be determined by the factors to be individually evaluated. High and low frequency of any signal can be placed in one pen if it has sufficient response to show both frequencies and need not be filtered and subjected to signal conditioning as was explained for amplifier 23*a*, although such conditioning is acceptable and commonly practiced.

Amplifiers 23*a*, 23*b* and 23*c* are shown with amplifier circuits 24 and 25 to disclose an advantageous cross-amplification control that is considered optional. The signal from each transducer may be used as an enabling amplification factor for other amplifiers, that is, in the case no signal is received from the controlling transducer there will be no output from the controlled amplifier. Thus, if noise is to give the false indication of a signal, the noise must be present on all channels simultaneously. Since, as will be described later, signals will be generated at preselected intervals, noise received at any but the prescribed intervals will be harmless.

Figure 8:
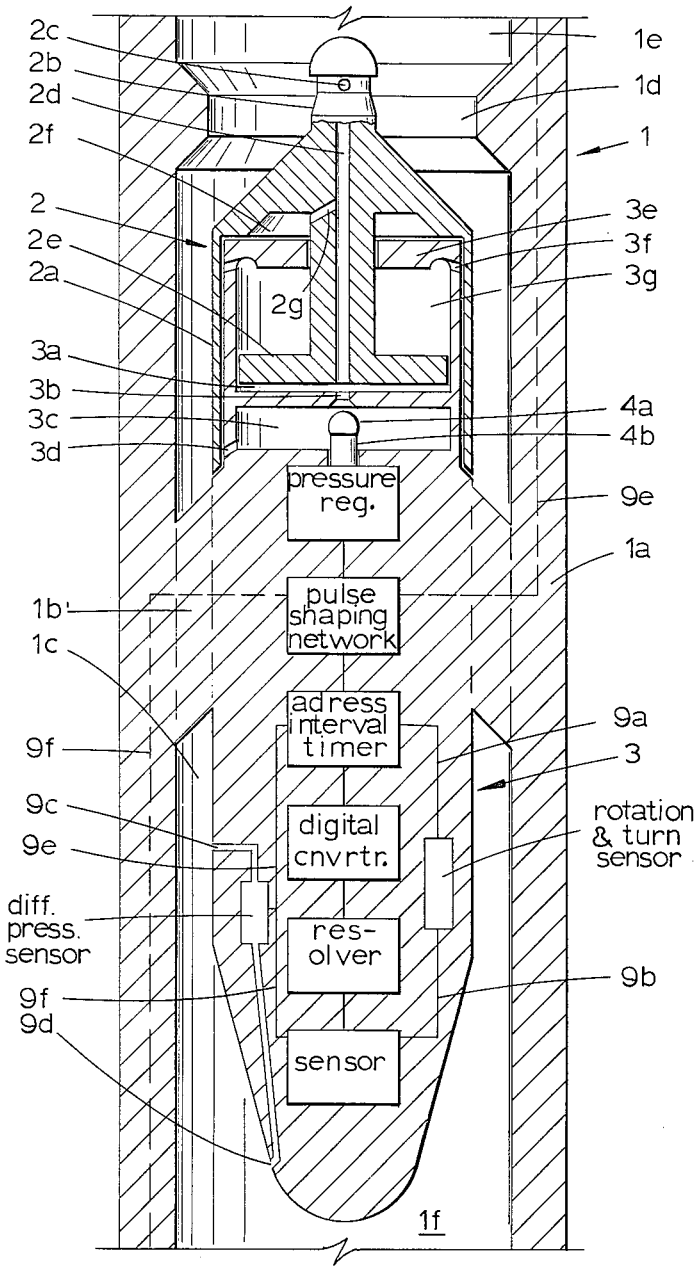
FIG. 8 is a vertical sectional view of a pulse code transmitter partly schematic.

FIG. 8 represents a preferred embodiment of the down hole transmitter of this invention. Member 1 is a continuation of the pipe string being attached above by means not shown to the upwardly continuing pipe string and attached below by means not shown to the downwardly continuing pipe string. Housing 3 contains the sensitive elements of the device and is supported within the bore 1*c* of member 1 on spiders such as 1*b*. Valve element 2 is supported by housing 3 for axial movement to and away from restriction 1*d* of member 1 to change the resistance to the flow of fluid traversing restriction 1*d*.

The sensor may be any form and location, or a plurality of sensors may be selectively addressed. Typical sensors are those that sense earth related parameters such as temperature, pressure, conductivity and specific gravity, or apparatus related parameters such as speed, drill bit load, drill bit torque, wear and quantitative position of apparatus elements. Sensors alternately indicate qualitative parameters such as valves open or closed and moving elements locked or free moving.

Information from the sensor is conveyed to the resolver. The resolver converts the sensor output to voltage if the sensor output is not already expressed as voltage. Voltage from the resolver is communicated to the digital converter. Digital converters capable of converting voltage to a sequence of symbols in a desired numbering system are well known.

The addressing interval timer addresses each place, in sequence, in the numerical expression produced by the digital converter at a rate that is acceptable for transmission of pulses in the pipe string. The addressing interval timer may be a combination of a stepping motor, power circuit to periodically step the motor and a selector switch driven by the stepping motor. Each signal in each numerical place addressed in the digital converter is communicated to a pulse shaping network.

The pulse shaping network receives the signal representing a numerical symbol from the addressing interval timer as an input and in response produces an output signal having power to operate a cooperating fluid pressure regulator and having such electrical characteristics that the responsive fluid pressure regulator will cause an actuator operating a valve in the fluid moving in the pipe to cause the valve to produce a pressure pulse in the fluid having characteristics that will be sufficiently evident in the pulse detected at the earth surface that the symbol produced by the digital converter can be identified by the pulse characteristics. The fluid pressure regulators operated may be elsewhere as shown in FIG. 1 and controlled by leads 9*e* and 9*f*. The pulse shaping network determines what type of signal and what frequency goes to each regulator if a plurality is used.

By processes to be described later, the pressure regulator regulates the fluid pressure supplied from the upstream side of valve element 2 to an actuator moving valve element 2 in response to electrical energy supplied the regulator by the pulse shaping network. The pressure differential produced across the valve is at any time proportional to the voltage supplied to the regulator. The actuator is comprised of cooperating elements of valve element 2 and housing 3. Surface 2*a* of valve element 2 cooperates with restriction 1*d* of the bore of member 1 to comprise a valve resisting the movement of fluid through the bore of member 1.

Opening 2*c* in probe 2*b* receives fluid from above restriction 1d and conducts it through channel 2*d*, through port 2*g* into opening 2*f*, and into opening 3*a*. If poppet 4*a* is downward, opening 3*b* allows fluid moving through channel 2*d* to flow into cavity 3*c*, out port 3*d* to the annulus 1*c* and pressure does not rise in openings 2*f* and 3*a;* therefore, no pulse is created in the fluid moving in the pipe string.

To create a positive pressure pulse as herein defined, the pulse shaping network supplies electrical energy to the solenoid (not shown) of the pressure regulator. The solenoid plunger 4*b* urges movable poppet 4*a* toward opening 3*b*. Pressure supplied by channel 2*d* is held in openings 2*f* and 3*a*. The pressure differential across opening 3*b* is proportional to the electrical energy supplied to the solenoid which, in turn, is proportional to the pressure in openings 2*f* and 3*a*. The cross sectional area of opening 2*f* constitutes a piston area urging element 2 upwardly. The effective piston area of piston 2*e* and opening 2*f* represents more area then the opening of restriction 1*d*.. Element 2, then, will move upwardly against any pressure across restriction 1*d*, limited only by the pressure regulator. Upward movement of piston 2*e*, displaces fluid from opening 3*g* through port 3*f*. Downward movement of the piston reverses the flow.

When no electrical power is supplied to the solenoid, poppet 4*a* is spring loaded downward by means (not shown) within the solenoid and fluid in openings 2*f* and 3*a* is discharged through opening 3*b* into cavity 3*c* out port 3*d*. Fluid moving downwardly through restriction 1*d* urges element 2 to move downwardly.

The description above shows that the device is capable of producing pressure pulses in the fluid stream proportional to electrical energy supplied to the solenoid. To create negative pulses, a background voltage is supplied to the solenoid to create a pressure drop across the valve. The negative pulse is produced by a temporary reduction in the background voltage. A passive pulse as herein defined is produced by an unchanged voltage supplied the solenoid, including zero voltage, at the time that a passive pulse is to be created. A high frequency cyclic variation is producible by an oscillator in the pulse shaping network and may be superimposed on the fluid pressure pulse by supplying an alternating component to voltage supplied to the regulator solenoid.

In current drilling practice down hole devices may remain down hole for over 200 hours. Hydrostatic pressure, high temperature and, while drilling, intense vibration make down hole timers hard to synchronize with timers at the earth surface. In this invention, timers would measure delay for pulse spacing. Delay may be accomplished in media other than chronologic time. Delay in terms of pipe string turns can readily be synchronized between the surface and down hole apparatus. The rotation and turn sensor can be used to scale or pace the address interval timer. The devices of FIG. 10 and FIG. 11 can be used to make the interval timer responsive to pipe string turns.

Circuitry capable of converting switch makes rates into voltage are quite common and are, hence, not shown in detail, but can be associated optionally with the sensor and interval timer to turn off the down hole communication assembly if the pipe string is rotating above preselected rates. Down hole equipment thus can be turned on or off as desired by actions at the earth surface which control pipe string rotation rates.

The differential pressure sensor measures the pressure of fluid moving in annulus 1e by port 9*c* and compares it with pressure in the bore 1*f* by port 9*d*. Fluid velocities at the two ports will be different if fluid is moving in the pipe string and, hence, the pressure defferential betwen ports 9*c* and 9*c* will vary with the variation in flow rate. Differential pressure information conveyed by lead 9*e* associated by a quantifying integrating circuit in the interval timer can be used in lieu of chronological time to pace the timer and establish time increment division of the time interval allocated to message transmission. Differential pressure transducers that produce a proportional electrical output are in common use and are not detailed. Integrating networks are likewise in common use and not shown in detail.

Since flow rates used for message transmission and flow rates for normal drilling often differ, it is desirable to use the differential pressure sensor to turn off the down hole telemetry apparatus. This is done by leads 9*e* and 9*f* when flow rates are within prescribed limits.

Figure 9:
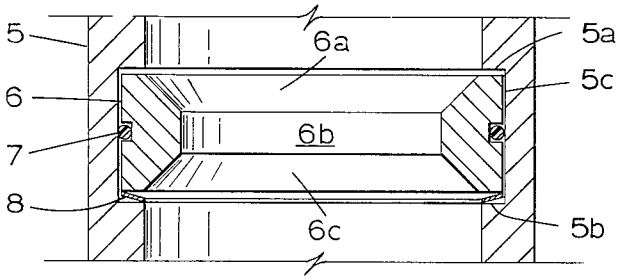
FIG. 9 is a vertical sectional view of an alternate embodiment of a part of the device of FIG. 8.

FIG. 9 represents a device to be used in conjunction with the embodiment of FIG. 8 to transform fluid pressure differential energy into a hammering energy to put axial stress energy into the drill string material. Moving element 6 comprises the flow restriction orifice 1*d* of FIG. 8 here shown as 6*b*. When a valve element such as element 2 of FIG. 8 approaches orifice 6*b*, a pressure differential exists between area 6*a* and 6*c*. This uges element 6 downwardly, overcoming spring 8 and ultimately causing the lower face of element 6 to strike face 5*b* of the peripheral cavity 5*c* in housing 5. An impact on a resilient body transmits on all frequencies the resonant frequencies being sustained longest. When the cause of pressure differential between areas 6*a* and 6*b* is removed, element 6 is urged upwardly by spring 8. The upper surface of element 6 may then strike face 5a. Seal 7 prevents fluid from bypassing element 6 around the outside. If the cause of pressure drop across element 6 is caused to oscillate axially at certain frequencies, a synchronous hammering will exist at face 5*b* and face 5*a*. Experiment will determine what cyclic frequency reinforcement of pulses is best transmitted in any particular system.

Figure 3:
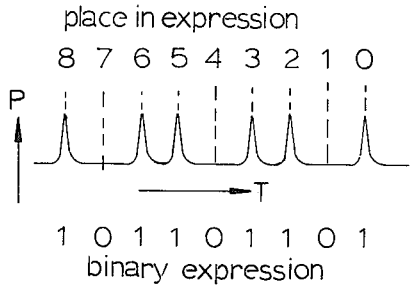
FIG. 3 is a graphic representation of a signal pressure versus time pulse signal that is expected to be employed in information transmission from very deep holes.

FIG. 3 represents a typical binary signal pulse series delivered to the pressure regulator solenoid of FIG. 8 as voltage versus time and approximates the pressure versus time signal that will be created in the fluid moving in the pipe string by the valve actuated in accordance with the embodiment of FIG. 8. Nine pulses are used, six active positive and three passive. The base 10 equivalent is 365. A message comprising nine binary symbols can conveniently transmit information concerning a compass bearing divided into 400 grads with 1 grad resolution. Such resolution is quite adequate for commonly practiced oil well drilling control work.

Figure 4:
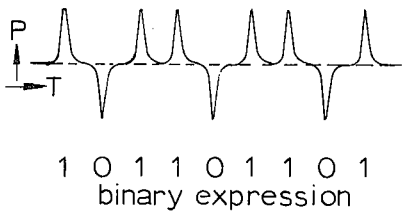
FIG. 4 is a graphic representation in terms of pressure and time that utilizes positive and negative pulses to transmit in a binary code.

FIG. 4 represents a typical binary signal series employing nine symbols, six positive pulses and three negative pulses. The neutral horizontal line represents a background voltage supplied to solenoid 4 of FIG. 8 to make possible the negative pulses.

Figure 5:
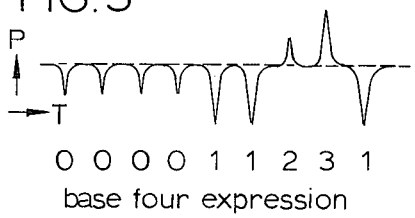
FIG. 5 is a graphic representation of a signal pressure versus time trace forming an expression in a base four numerical system.

FIG. 5 represents a typical voltage versus time trace supplied to the solenoid of the pressure regulator of FIG. 8 when circumstances permit transmission of two distinctive, identifiably different fluid pressure pulses of each polarity. Vertical height represents voltage to the solenoid and fluid pressure across the valve. Lower and higher pressure pulses of each polarity are assigned different symbols. A base four numerical system is thus provided without the use of passive pulses. When passive pulses are not used, time spacing of pulses is not so important and the pulses can be accepted as received in sequence, the order being used to determine the place for each symbol of the expression being communicated.

Figure 6:
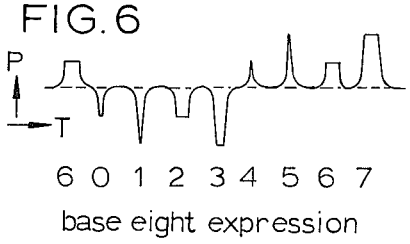
FIG. 6 is a graphic representation of a signal pressure versus time trace forming an expression in a base eight numerical expression.

FIG. 6 represents voltage or pressure versus time for the transmission of a base 8 numerical expression. Here pulse duration as well as pulse potential or pressure differential is used as distinguishing features. Since no passive pulses are used, timing between pulses may be spaced to aid in the identification of pulses in terms of symbols represented.

Figure 7:
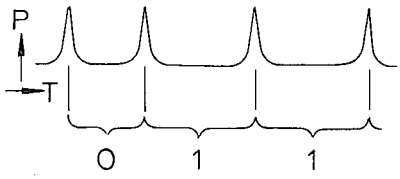
FIG. 7 is a graphic representation of a signal pressure versus time trace forming a binary numerical expression, one symbol of which is composed of two pulses.

FIG. 7 represents a voltage and pressure trace versus time incorporating pulse spacing to identify particular sumbols. Only two different spacings are shown for use in a binary system. In this case spacing delay is related to a particular number of turns of the pipe string.

The single pulses shown may actually have high frequency components or may represent energy in bursts of high frequency transmissions, with the signal conditioned to yield display pulses as shown.

Obviously any combination of pulses may be used to identify a single symbol. For instance, a single pulse may represent 0 and two closely spaced pulses may represent 1 in a binary system.

Figure 10:
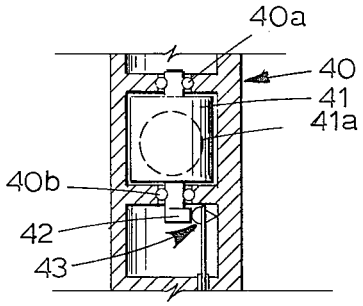
FIG. 10 is a vertical sectional view of a pipe string turn counter shown in FIG. 8.
Figure 12:
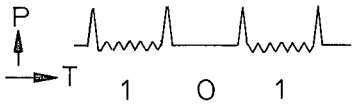
FIG. 12 is a pressure versus time graphical representation of three information pulses of cyclic variations separated by separator change pulses.
Figure 13:
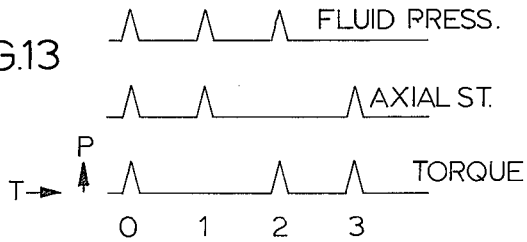
FIG. 13 is a pressure versus time graphical representation of four information pulses formed of correlated signal components transmitted in three modes representing four different symbols.

The device of FIG. 10 represents the rotation and turn sensor of FIG. 8. Switch 43 opens and closes at a rate proportional to the rate of rotation of housing 40 relative to gyroscope assembly 41. Gyroscope 41*a* holds assembly 41, which includes power supply and controls, stable relative to earth. Housing 40 may be considered part of housing 3 of FIG. 8. Assembly 41 rotates on bearings 40*a* and 40*b* and rotates cam 42 in contact with grounding switch 43 which is connected to the address interval timer and a sensor of FIG. 8.

Figure 11:
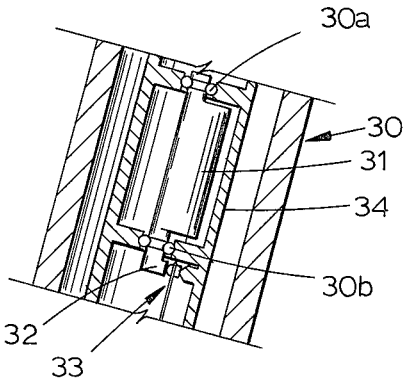
FIG. 11 is a vertical sectional view of an alternate form of a turn counter for use with the device of FIG. 8 in slanted holes.

The device of FIG. 11 is an alternate form of the rotation and turn counter of FIG. 8 and is simpler than the device of FIG. 10. It is intended for use in slanted holes. Eccentric mass 31 has a center of gravity radially displaced from its axis of rotation on bearings 30*a* and 30*b*. The center of rotation of the bearings will ideally be on the axis of rotation of the pipe string. Member 30 may be the pipe string and housing 34 may be a part of housing 3 of FIG. 8. Cam 32 rotates with mass 31 and operates grounding switch 33 which is connected to leads 9*a* and 9*b* of FIG. 8.

From the foregoing, it will be seen that this invention is one well adapted to attain all of the ends and objects hereinabove set forth together with other davantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, what is claimed is:

1. A method for transmitting information between opposite ends of a length of fluid filled duct comprising the steps of pumping fluid through the duct, encoding the message to be transmitted into a combination of a first code component and a second code component, generating at a first end of the duct at least one signal pressure change pulse in the fluid moving in the duct, said pressure change pulse having characteristics corresponding to said first code component, generating at said first end of the duct signal stress variations in the wall material of the duct which correspond to said second code component, detecting at a second end of the length of duct both the pressure change signals and the stress variation signals, combining the detected signals corresponding to said first and second code components into the original code so that the transmitted message may be decoded.

2. A method for transmitting messages between opposite ends of a length of a fluid filled pipe string in an earth borehole operation by the use of signal pulses created in the materials within the pipe string outer surface envelope comprising the steps of formulating the messages as an expression in a code system the base of which corresponds to the number of distinctively different pulses that can be detected after the pulses travel between opposite ends of the length of pipe string, pumping fluid through the pipe string, restricting the movement of fluid moving in the pipe string at a first end of the length of pipe string to create at least one brief pressure change that can be detected at a second end of the length of pipe string for each place in said expression, creating signal stress variations at said first end of the length of pipe string in the pipe string wall material that can be detected at said second end to identify selected pressure pulses as distinctively different from other pressure pulses so that the combination of said signals may be used to transmit signals in a code system having at least a base of two.

3. The method of claim 2, the base being two, the characteristic of the pulse by which they can be distinguished being the absence or existence of a stress variation in the pipe string wall in correlation with said pressure pulses.

4. A method of improving the identification of signal pressure pulses created in fluid at one end of a fluid filled pipe string and transmitted through the fluid in the pipe string comprising the steps of creating signal pressure pulses in the fluid in the pipe string at a first end, creating pulses consisting of stress variations in the side wall material of the pipe string at said first end detectable at a second end of the pipe string in correlation with said pressure pulses, the detection of both pulses serving to aid in the identification of each pulse over background noise.

5. A method of compensating for the difference in travel speed of pulses generated at a first end of a fluid filled pipe string and traveling through the fluid and the pipe string wall material to be detected at a second end comprising the steps of detecting pulses in both the fluid and the pipe string wall at said second end delaying the presentation of the fastest traveling pulses as they arrive at said second end an amount of time representing the difference in travel time so that as the pulses are presented the time relationship corresponds to the time relationship between the pulses moving in the fluid and those moving in the pipe string wall, as generated.

6. A communication system for transmitting messages between a first end and a second end of a fluid filled pipe string in a earth bore hole comprising; means at said first end of the pipe string to convert the message into at least one digital word, means to convert each word into a number of data bits, means to convert each of said bits into at least one pressure pulse signal in the fluid and at least one stress variation pulse signal in material of the pipe string, means at said second end of the pipe string to detect said stress variation pulse signals and said pressure pulse signals, means responsive to said detector means to present said pulse signals so that said signals can be reassociated so that a combination of pressure pulse and stress variation signals may be further reconverted into said message.

7. Apparatus for transmitting information to the earth surface from a down hole device attached to a fluid filled pipe string extending to the surface comprising; means responsive to an output from a cooperating sensor to create a finite series of individual pressure pulses in the fluid in the pipe string, means responsive to said sensor to create pulses of cyclic stress variations in the material of the pipe string, each pressure pulse having characteristics because of its association with stress pulses that identify it exclusively as exclusively representative of at least a part of a symbol in a numerical system used in pressure pulse transmission, said finite series of pressure pulses, each by its position in said series, identifiable with a particular place in said numerical expression, said finite series of pressure pulses collectively being identifiable as representative of said numerical expression which, in turn, is representative of the information content of the output of said sensor.

8. Apparatus for transmitting information to the earth surface from down hole devices attached to a fluid filled pipe string extending to the surface through which fluid is pumped by creating brief changes in the resistance to flow of fluid in the pipe string to cause pressure pulses in the fluid and stress variations in the pipe string wall material detectable at the earth surface comprising; converter means responsive to the signal output of a sensor to convert said signal into a finite number of incremental signals, the number of increments corresponding to the number of symbols to be used in an expression to be transmitted to the earth surface, means to address each incremental signal in said converter means by one in a preselected order and rate, means responsive to said addressing means and to each incremental signal as addressed to transform each incremental signal separately into each of a combination of pressure pulses in the fluid flowing in the pipe string, and stress variation pulses in the material of the pipe string wall by briefly changing the resistance to the flow of fluid, said pulses collectively having such characteristics detectable in the fluid and pipe string wall at the earth surface as to identify each pulse as representative of the particular symbol in the increment addressed, the series of pulses collectively containing pulses transmitted through the fluid and pulses transmitted through the pipe string wall and recognizable as representative exclusively of the signal from said sensor.

9. The apparatus of claim 8, said expression being a binary numerical expression, said pulses being of two forms, one form being a pressure change pulse in said fluid, the other form containing cyclic variations in the pipe string wall, each pulse form representing one of the binary symbols used in said numerical expression.

10. The apparatus of claim 8, being further provided with means to induce cyclic variations in said pressure pulse produced in the fluid during the time of generation of a pressure pulse.

11. The apparatus of claim 8, being further provided with means to convert at least part of the energy of said pressure pulse in the fluid in the pipe string into vibration energy in the pipe side wall material as an aid to signal identification at the earth surface.

12. The apparatus of claim 11 in which said converter means is an oscillating axially moving mass to deliver hammering blows to the pipe string to produce stress oscillations in the pipe string side wall.

13. Apparatus for transmitting to the earth surface information produced by subsurface apparatus attached to a fluid filled pipe string by pressure pulses created in the fluid in the pipe string and stress variation pulses in the wall material of the pipe string at the subsurface location and detectable in the fluid and in the wall material in the pipe string at the earth surface comprising; means responsive to a subsurface sensor to convert information signals produced by said sensor into a finite series of independent signals collectively representing a numerical expression in a number system having a base corresponding to the number of distinctively different pulse signals to be used in information transmission, means to address in a preselected sequence each individual signal produced by said converter means and to transmit a signal representing the independent signal in the converter means being addressed to a cooperating pulse creating means, means responsive to the nature of each of said independent signals delivered by said addressing means to separately create in the pipe string a combination of at least one pressure pulse and at least one stress variation pulse which, when detected at the earth surface, will have such distinctive characteristics in the manner of pulse combination that it is identifiable as representative of the related independent signal delivered by said converter means, whereby a series of pulses are usable by their individual natures as representative of individual numerical symbols and by their order of arrival at the earth surface collectively represent a numerical expression that, in turn, represents the output of said down hole sensor.

14. Apparatus for transmitting information to the earth surface from down hole devices attached to a fluid filled drill string extending to the surface with a drill bit attached to the lower end to engage the earth for drilling comprising; a resolver means responsive to the output of a sensor to convert the output of said sensor to produce a secondary signal having properties acceptable to a cooperating digital converter, a digital converter means to convert said secondary signal to a series of symbols representative of a digital numerical expression in the numerical system to be used in pulse information transmission, and addressing sequencing means to address each symbol place in the digital converter individually in turn and to convey a signal representative of each symbol to a cooperating pulse shaping network, means responsive to said shaping network to shape each signal received from said sequencing means to convey shaped signals to a cooperating pressure regulator such that said regulator responsive to said shaped signals will produce a pressure pulse by changing resistance to flow of fluid moving in the pipe string having such individually distinctive characteristics that said pulse may be identified as representative of an individual symbol of the numerical system being used in transmitting information to the earth surface, means responsive to the fluid pressure signal energy to apply a downward force on the lower end of the drill string to cause a drill bit rotating against the earth to produce a torque chance pulse to confirm the existence of a pressure pulse signal over noise.

15. A communication system for transmitting information to the earth surface from down hole apparatus attached to a fluid filled pipe string extending to the earth surface by creating down hole a combination of changes in the resistance to flow of fluid in the pipe string detectable as brief pressure changes in fluid pressure at the earth surface and brief changes in stresses in the pipe string detectable in the pipe string at the earth surface comprising; means down hole to cause brief restrictions to flow of fluid in the pipe string to create a pressure differential across said restriction, means to convert at least a part of the energy involved in the flow of fluid through said restriction to cause stress changes in the pipe string detectable at the surface, means responsive to a sensor to formulate the information produced by said sensor into a message comprising a finite series of symbols and cause pulses to be produced in the fluid and pipe string representing one by one each symbol in said message, means to regulate the relationship between the characteristics of a pressure pulse produced by the action of said restriction and the characteristics of a pulse composed of said stress changes in the pipe string such that each pulse is identifiable at the surface as representative of at least a part of a particular symbol, means at the surface to detect said pulses in the fluid and in the drill string.

16. The system of claim 15 being further provided with means to compensate for the difference in travel time between signal pulses in the fluid and signal pulses in the pipe string so that pulses transmitted by both media may be evaluated in the time relationships be which they were generated down hole.

17. The system of claim 15 being further provided with means to corelate at least one pair of signal detection means such that a first signal is used to control the amplification of a second signal so that in the absence of either, the second signal amplification is zero and whatever the original value of the second signal, it will emerge from the amplifier as zero.

18. The system of claim 15 in which means to increase axial resilience of the pipe string is used above means to restrict fluid flow and below means to restrict fluid flow so that the actuation of said restriction means above said resilient means, when a drill bit is drilling, will cause a certain ratio of apparent bit weight change and torque change, the actuation of said restriction means below said resilient means causing a smaller ratio of apparent bit weight change and torque change so that the ratio between signals received at the surface will indicate which restriction means was actuated to produce said signals, said ratio serving to identify certain signals with particular symbols.

19. Apparatus for use in earth bore hole operations for transmitting information to the earth surface from down hole devices attached to a pipe string extending to the earth surface by creating changes in stress in materials within the pipe string that can be detected in the materials within the pipe string at the earth surface comprising; means responsive to a down hole sensor to convert information produced by said sensor into a finite series of independent signals each representing a symbol and said series collectively representing a numerical expression in a number system having a base corresponding to the number of distinctively different stress change characteristics to be used in transmitting information, means to address in a preselected sequence and rate each individual signal produced by said converter means and transmit said signals one by one to a cooperating distributor means, means responsive to said signals as each is addressed independently to separate said signal into at least two components any of which may be transmitted as pressure pulses in fluid in the pipe string and to be transmitted by stress changes caused down hole in the drill string wall material and to distribute said components to means to create signals in the pipe string and fluid, means responsive to a first of said signal components to create stress changes in the pipe string wall that are detectable in the pipe string at the earth surface, means responsive to a second of said signal components to create pressure changes in the fluid in the pipe string detectable in the fluid at the earth surface, the signal energy in the pipe string wall and in the fluid by their collective characteristics being distinguishable as representative of particular symbols in a numerical expression being used to transmit information, said series of stress change signals collectively recognizable as representative of the numerical expression produced by said sensor.

* * * * *